US008899677B2

(12) United States Patent
Hurlburt

(10) Patent No.: US 8,899,677 B2
(45) Date of Patent: Dec. 2, 2014

(54) COMBINATION STADIUM SEAT CUSHION AND ADAPTABLE BANNER

(71) Applicant: Unsil C. Hurlburt, Saginaw, TX (US)

(72) Inventor: Unsil C. Hurlburt, Saginaw, TX (US)

( * ) Notice: Subject to any disclaimer, the term of this patent is extended or adjusted under 35 U.S.C. 154(b) by 2 days.

(21) Appl. No.: 13/804,805

(22) Filed: Mar. 14, 2013

(65) Prior Publication Data

US 2014/0265464 A1 Sep. 18, 2014

(51) Int. Cl.
*A47C 31/00* (2006.01)
*A47C 13/00* (2006.01)

(52) U.S. Cl.
CPC ..... *A47C 13/00* (2013.01)
USPC ..... 297/219.1; 297/250.1; 297/230.1; 297/452.17; 297/217.1; 5/653

(58) Field of Classification Search
CPC ... A47C 7/021; G09F 23/00; G09F 2023/005; G09F 23/0066
USPC ..... 297/230.1, 250.1, 219.1, 452.17, 217.1; 5/653
See application file for complete search history.

(56) References Cited

U.S. PATENT DOCUMENTS

| | | | | | |
|---|---|---|---|---|---|
| 2,788,533 | A | * | 4/1957 | Bornstein | 5/419 |
| 3,336,610 | A | * | 8/1967 | Geddings | 5/420 |
| 4,441,271 | A | * | 4/1984 | Hutchinson | 40/584 |
| 4,637,151 | A | * | 1/1987 | Love et al. | 40/584 |
| 4,843,662 | A | * | 7/1989 | Handelman | 5/653 |
| 4,925,241 | A | * | 5/1990 | Geraci | 297/229 |
| 4,967,428 | A | * | 11/1990 | Browder | 5/419 |
| D343,088 | S | * | 1/1994 | Owens | D6/601 |
| 5,454,125 | A | * | 10/1995 | Ratkowski | 5/417 |
| D363,951 | S | | 11/1995 | Chatman | |
| D366,800 | S | * | 2/1996 | Moore, Jr. | D6/601 |
| 5,491,851 | A | * | 2/1996 | Alonso | 5/722 |
| 5,572,758 | A | * | 11/1996 | Merritt | 5/653 |
| 5,884,331 | A | * | 3/1999 | Barajas | 2/69 |
| 5,920,931 | A | * | 7/1999 | Zuehlke et al. | 5/419 |
| 5,950,260 | A | * | 9/1999 | Dees | 5/420 |
| 6,152,952 | A | * | 11/2000 | Owens | 607/108 |
| 6,240,666 | B1 | | 6/2001 | Apel et al. | |
| 6,691,356 | B1 | * | 2/2004 | Coma | 5/722 |
| 6,708,343 | B1 | * | 3/2004 | Ceron | 2/88 |
| 6,848,746 | B2 | * | 2/2005 | Gentry | 297/380 |
| D508,183 | S | | 8/2005 | Lambden et al. | |
| 7,343,636 | B1 | * | 3/2008 | Castillo | 5/653 |
| 7,596,821 | B2 | * | 10/2009 | Pawlowski | 5/655.7 |
| D634,951 | S | | 3/2011 | Dreiling | |
| 8,029,426 | B2 | * | 10/2011 | Sohn | 482/145 |
| 2004/0239703 | A1 | * | 12/2004 | Angelica | 345/962 |

(Continued)

*Primary Examiner* — Laurie Cranmer
(74) *Attorney, Agent, or Firm* — Decker, Jones et al.; Brian K. Yost; Geoffrey A. Mantooth

(57) ABSTRACT

A compact seat cushion that may be expanded to reveal a banner wherein the banner may be changed in accordance with the desires of the user is provided. In a preferred embodiment, the device comprises a foldable length of material which, when in a folded position, may be used as a seat cushion, and when in an expanded, unfolded position, may be used as a banner to display letters, logos, messages or other insignia. In certain embodiments, the device comprises a plurality of conjoined panels, each comprising a closed compartment comprising padded material. One or more of the panels comprise an upper layer and a lower layer joined together to form a compartment comprising padding. A plurality of strips is adapted for cooperative coupling insignia. A user desiring to form a banner may do so easily by coupling letters or phrases to the unfolded seat.

11 Claims, 6 Drawing Sheets

(56) References Cited

U.S. PATENT DOCUMENTS

2004/0264166 A1* 12/2004 Chien ..... 362/84
2006/0042014 A1* 3/2006 Martin ..... 5/653
2010/0050485 A1* 3/2010 Forte et al. ..... 40/1.5
2010/0059558 A1* 3/2010 Robinson et al. ..... 224/155
2010/0095571 A1* 4/2010 James ..... 40/586
2010/0186269 A1* 7/2010 Suprina ..... 40/1
2012/0186121 A1* 7/2012 Hanssen et al. ..... 40/633

* cited by examiner

COMBINATION STADIUM SEAT CUSHION AND ADAPTABLE BANNER

FIELD OF THE INVENTION

The present invention relates generally to seat cushions and specifically to a combination stadium cushion and adaptable banner that can be used both as a cushion and sign at sporting events

BACKGROUND OF THE INVENTION

Sports such as football, baseball, hockey, basketball, and soccer are immensely popular in the United States as well as many parts of the world. At virtually all levels, from pee wee up through the highest professional leagues, sports competitions take place on fields and in arenas that have designated seating and viewing areas for spectators to watch and enjoy the activities. In some venues such as major league professional events, seating is provided and, in some sections, quite plush and comfortable. However, in many venues, the seating, if any, is often rather primitive in certain areas and amounts to little more than a hard wooden or metallic bench or set of bleachers. Because of these conditions, many spectators choose to carry their own seat cushions to help ease the discomfort during, what at times are, very long contests. The cushions brought into arenas range in complexity from foam pads to rather elaborate self-contained folding seats comprising both a cushioned seat bottom and a cushioned seat back.

In addition to viewing the events taking place within sporting venues, many spectators desire to take a more active role in the experience. For example, many spectators wear the colors of their favorite team or even replica jerseys and hats. Still others bring signs and banners to show support. These signs may be simple, relatively small, images and photographs or more complex messages like "WE LOVE TCU!" or "GO TEAM!!!"

In recent years, many venues have established limitations on the size of material that may be brought into the stadium or spectator areas. Additionally, even upon arriving near the venue, many spectators must travel considerable distances from the car, bus, subway, train, or other source of transportation, in order to enter the event. These distances often limit the spectator's ability to comfortably carry large items into or near the venue. Fans who desire to display a banner or message almost always create such banners and messages before arriving at the venue. Therefore, as the events unfold, such fans are unable to present messages that are particularly pertinent to the specific circumstances the fans are viewing.

For these and other reasons, there is a need for a compact seat cushion that may be expanded to reveal a banner wherein the banner may be changed in accordance with the desires of the user. The current disclosure provides such a combination seat cushion and banner.

DESCRIPTION OF THE PRIOR ART

A number of patents teach seat cushions and seat related display surfaces. For example, U.S. Pat. No. 4,441,271 issued to Hutchinson teaches a combination portable seat cushion and pennant that can display team colors, words comprising team cheers and the like. U.S. Pat. No. 4,637,151 issued to Love et al. discloses a combination portable stadium cushion and pennant with transparent pockets in which bumper stickers or other sports insignia may be inserted and displayed. U.S. Pat. No. 7,343,636 issued to Castillo discloses a combination cheering aid and seat cushion. U.S. Pat. No. 5,572,758 issued to Merritt teaches a combination seat cushion and cheering aid on which an insignia of a team such as a university or professional football team may be imprinted. U.S. Design Pat. Des. 363,951 issued to Chatman illustrates an ornamental design for a combined cushion, sign, and sign holder. U.S. Design Pat. D634,951 issued to Dreiling illustrates an ornamental design for a stadium seat. U.S. Design Pat. D508,183 issued to Lambden et al. illustrates an ornamental design for a seat cushion U.S. Pat. No. 6,240,666 issued to Apel et al. discloses a fold out, inflatable information carrier with a hook and loop perimeter to which an information banner can be attached. U.S. Pat. No. 5,454,125 to Ratkowski discloses a self-contained multipurpose comfort device that can be used as a seat cushion and can be unfolded to display a logo or insignia. However, there remains a need for a compact seat cushion that may be easily expanded to reveal a banner wherein the banner is adapted to display complex and elongated insignia and capable of being readily changed in accordance with the desires of the user.

SUMMARY OF THE INVENTION

The present disclosure provides a compact seat cushion that may be easily expanded to reveal a banner wherein the banner is adapted to display complex and elongated insignia and capable of being readily changed in accordance with the desires of the user. In a preferred embodiment, the device comprises a foldable length of material which, when in a folded position, may be used as a seat cushion, and when in an expanded, unfolded position, may be used as a banner to display letter, logos, messages or other insignia. The device of the preferred embodiment comprises a plurality of conjoined panels, each comprising a closed compartment comprising padded material. In the preferred embodiment, six panels arranged side by side comprise the length of the device. Two end panels and four interior panels comprise this six panel array. Each of the panels is generally rectangular in shape and comprise an upper layer and a lower layer joined together to form the compartment within a rectangular panel perimeter. Being rectangular, each panel perimeter comprises a length and a width such that two side edges comprise the length, and two borders comprise the width, the side edges comprising the length being shorter than the borders comprising the width. Except for an exposed end edge of each of the end panels, the panels are joined with each other along the longer borders of each panel.

The end panels have slightly longer side edges than the interior panel side edges such that when the device is folded, the exposed side edges of each end panel may be positioned adjacent to one another.

The device may be folded such that each panel can be positioned against adjacent panels. The panels are coupled to one another, in part, by one or more reinforcement members. Each reinforcement member is biased to permit the two panels to fold away from the surface to which the reinforcement member is attached. In the preferred embodiment, the reinforcement members are alternatively sewn to the upper and lower surface of each panel such that the panels may be easily folded upward and downward in an alternating pattern.

When the device is expanded into an unfolded position, the upper and lower surfaces of each panel are revealed. Along the length of the device and between the side edges of each panel are a plurality of strips adapted for cooperative coupling with various insignia such as letters, numbers, images, logos, and the like. In the preferred embodiment, the cooperative strips comprise a hook and loop system. The hook portions may be coupled to the device or on the insignia. In the preferred embodiment, the hook portion is coupled to the device on the lower surface. With this arrangement, a user desiring to form a banner may do so easily by coupling letters, phrases or other insignia to a surface of the unfolded seat. In the preferred embodiment, the device comprises carrying straps and a tie strap. The tie strap permits the device to be maintained in a folded compact position. The carrying straps are adapted to permit the user to easily transport the device from place to place.

The present disclosure also presents a method of using a seat cushion to display a message. In the preferred embodiment of the method, the method comprises the steps of providing a banner adapted to be folded into a seat, applying one or more insignia to a surface of the banner when the banner is in an unfolded position.

In other preferred embodiments, the method of using a seat cushion to display a message comprises the steps of providing a seat cushion, the cushion comprising a foldable length of material which, when in a folded position, is adapted for sitting, and when in an expanded, unfolded position, is adapted for use as a banner; providing one or more insignia adapted to be removably coupled to a surface of said seat cushion; the surface being adapted for receiving the insignia; coupling the one or more insignia to the seat cushion, and displaying the unfolded seat cushion.

DESCRIPTION OF THE PREFERRED EMBODIMENT

Figure 1:
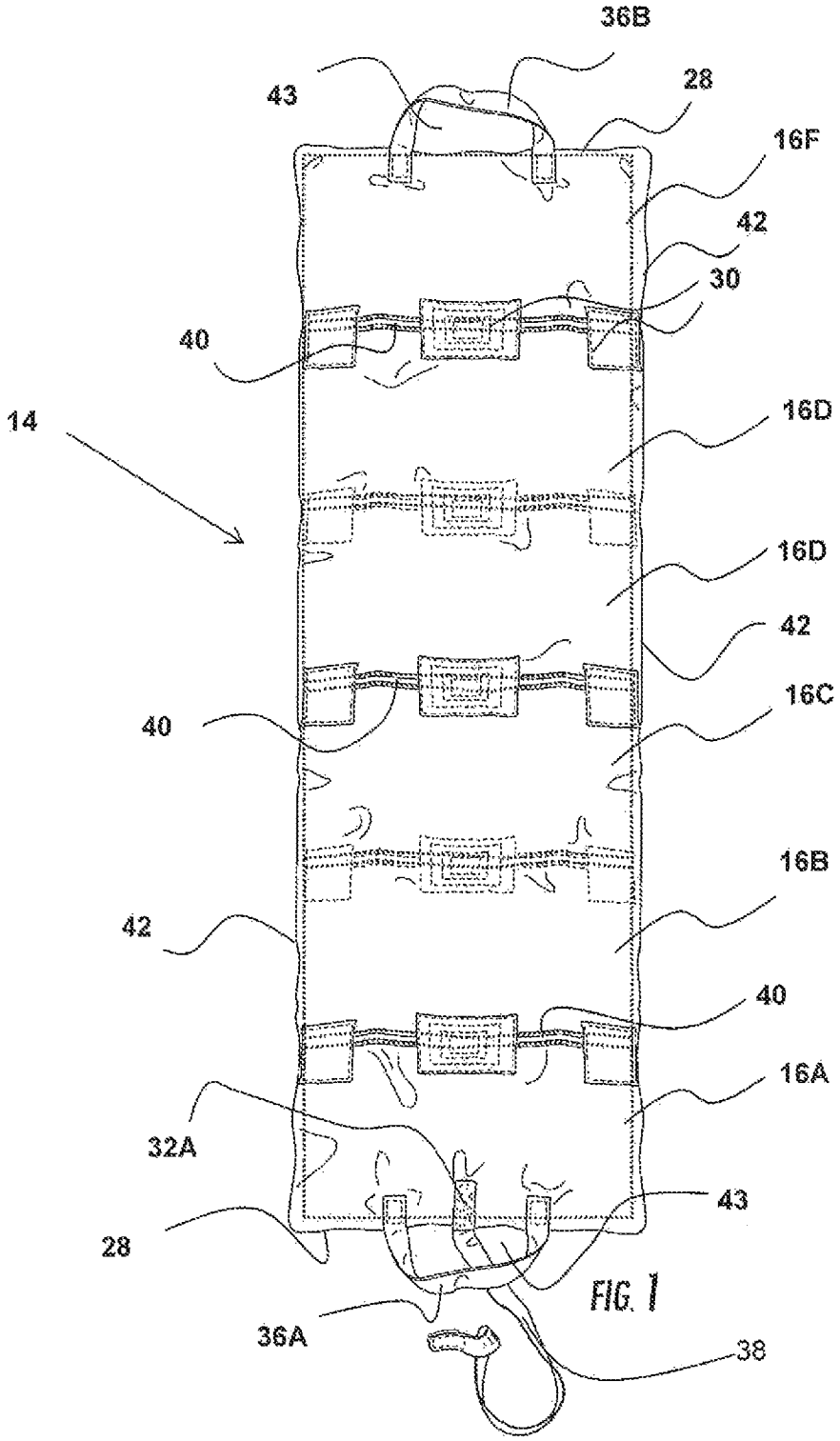
FIG. 1 is a plan view of the upper surface of the device in an unfolded position, in accordance with a preferred embodiment.

A preferred embodiment of the device 14 is presented in the figures referenced above. In describing the embodiments of the invention, specific terminology will be used for the sake of clarity. However, the invention is not intended to be limited to the specific terms so selected, it being understood that each specific term includes all technical equivalents operating in a similar manner to accomplish a similar purpose. It is understood that the drawings are not drawn exactly to scale. In the drawings, similar reference numbers are used for designating similar elements throughout the several drawings.

This specification and appended claims describe particular embodiments of the invention. However, it should be understood, based on this disclosure, that the invention is not limited to the embodiments detailed herein. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, aspects, adaptations, variations, alternatives, and uses of the invention, including what is presently believed to be the best mode of carrying out the invention.

The examples and illustrations of a combination stadium seat and adaptable banner are described herein with respect to a seat and banner for use at sporting events. However, the inventive system is equally applicable for use with other types of seats and for displaying other messages and objects in other environments. Moreover, while certain materials are discussed herein with respect to various components of the various embodiments, the embodiments are not limited to such materials. For example, in a preferred embodiment, certain components are formed from vinyl, cloth, and leather material. However, as will be discussed in more detail below, the components of the device may comprise any suitable materials without departing from the scope and spirit of this disclosure.

Figure 2:
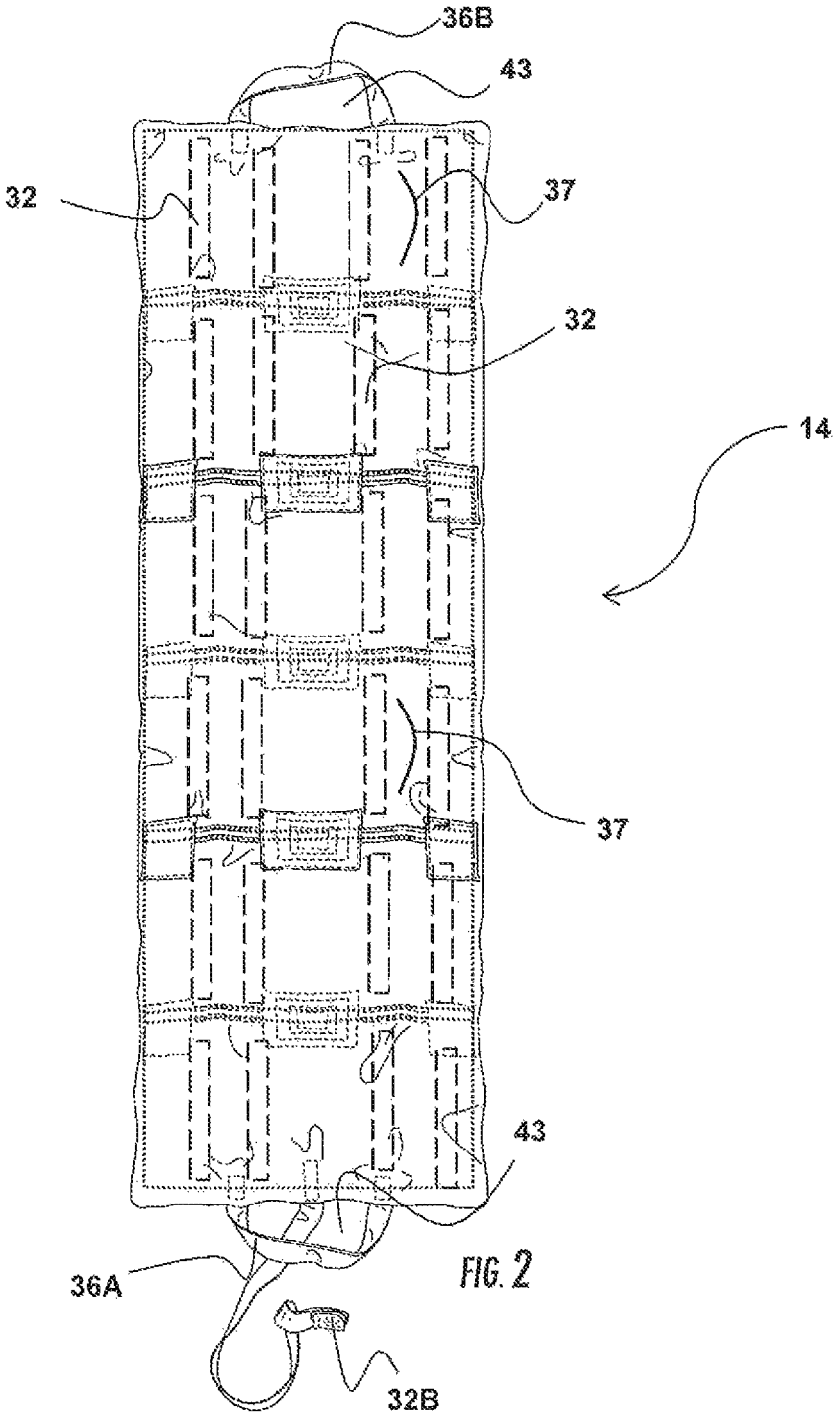
FIG. 2 is a plan view of the lower surface of the device in an unfolded position, in accordance with a preferred embodiment.
Figure 3:
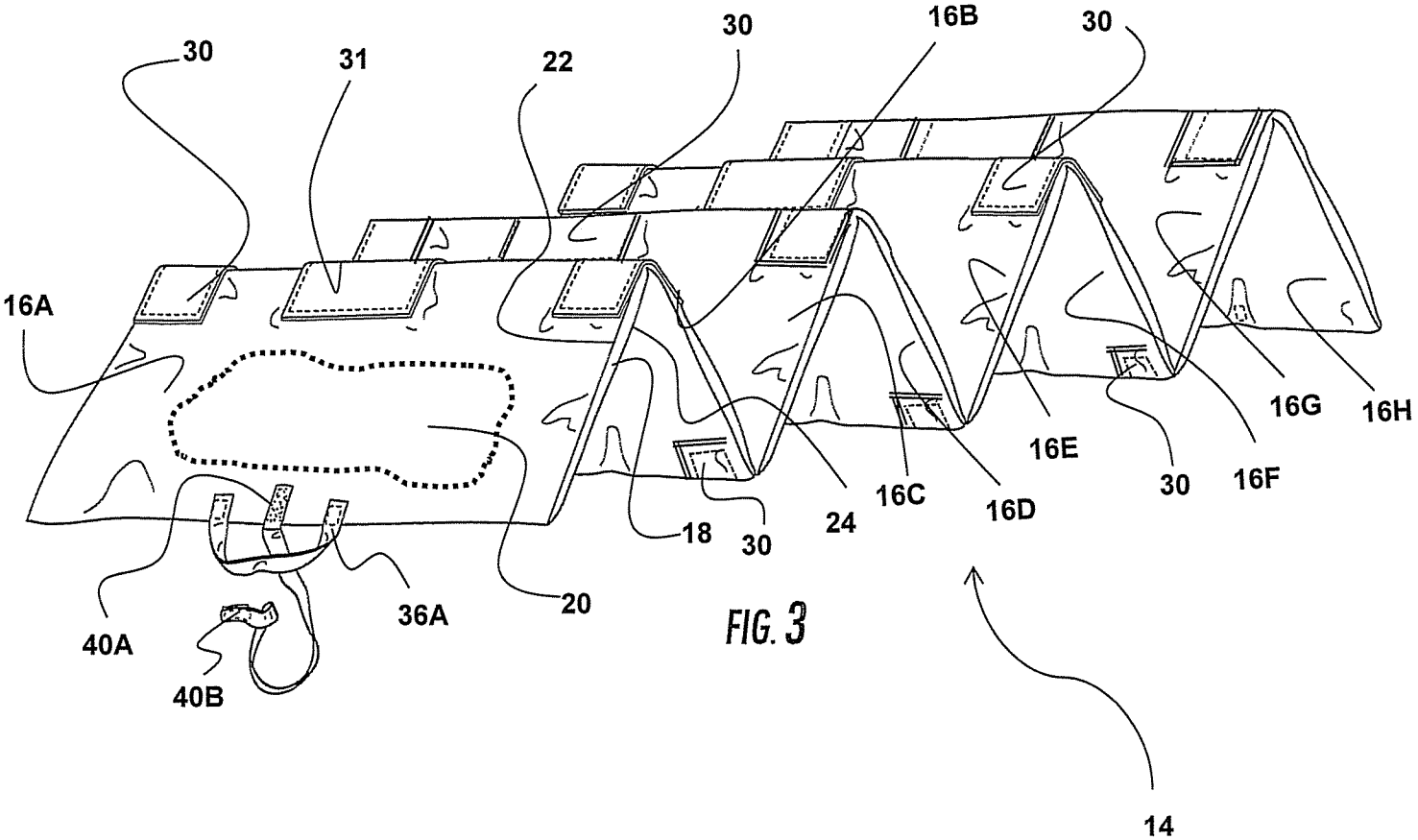
FIG. 3 is an isometric side view of the device in a partially folded position, in accordance with a preferred embodiment.

Referring to FIGS. 1-6 in a preferred embodiment of the present invention, the device 14 generally comprises a foldable length of material which, when in a folded position, may be used as a seat cushion 14, and when in an expanded, unfolded position, may be used as a banner 35 to display insignia such as letters, logos, and/or messages. The device 14 of the preferred embodiment comprises an array 16A-16F of conjoined panels 16A-16F, each comprising a closed compartment 18 (see FIG. 3) comprising padded material 20 (FIG. 3). In the preferred embodiment, six panels 16A-16F coupled side by side make up the length of the device 14. However, as will be discussed below, the device 14 may have greater or fewer panels 16A-16F than six. For example, in another embodiment, as illustrated in FIG. 3, the device 14 may have eight panels 16A-16H. By way of another example, other embodiments may have four panels 16A-16D. For purposes of this disclosure, unless otherwise indicated, the description will refer to a six panel 16A-16F embodiment (FIGS. 1, 2, 4, & 6). Referring to the embodiments illustrated in FIGS. 1, 2, & 6, two end panels 16A, and 16F and four interior panels 16B-16E comprise this six panel array 16A-16F. Each of the panels 16A-16F is generally rectangular in shape and, referring to FIG. 3, comprise an upper layer 22 and a lower layer 24 joined together to form the compartment 18 within a rectangular panel perimeter. Referring to FIG. 1, being rectangular, each panel 16A-16F perimeter comprises a longer boarder 40 and a shorter side edge 42 such that the side edges 42, 42 define the length of each panel 16A-16F and two boarders 40, 40 define the width. With respect to interior panels 16B-16E, the shorter boarders 42 comprise panel side edges 42 and the longer boarders 40 are shared with an adjoining panel 16A-16F. End panels 16A and 16F, comprise two side edges 42 and an end edge 28. Collectively, the side edges 42 of the interior panels 16B-16E and end panels 16A, 16F, define the length of the device 14. Except for the exposed end edge 28 resulting from longer side edges 42 (as compared with side edges 42 of each interior panel 16B-16E), of each of the end panels 16A, 16F, the panels 16A-16F are joined with each other along the longer boarder of each panel 16A-16F.

Figure 4:
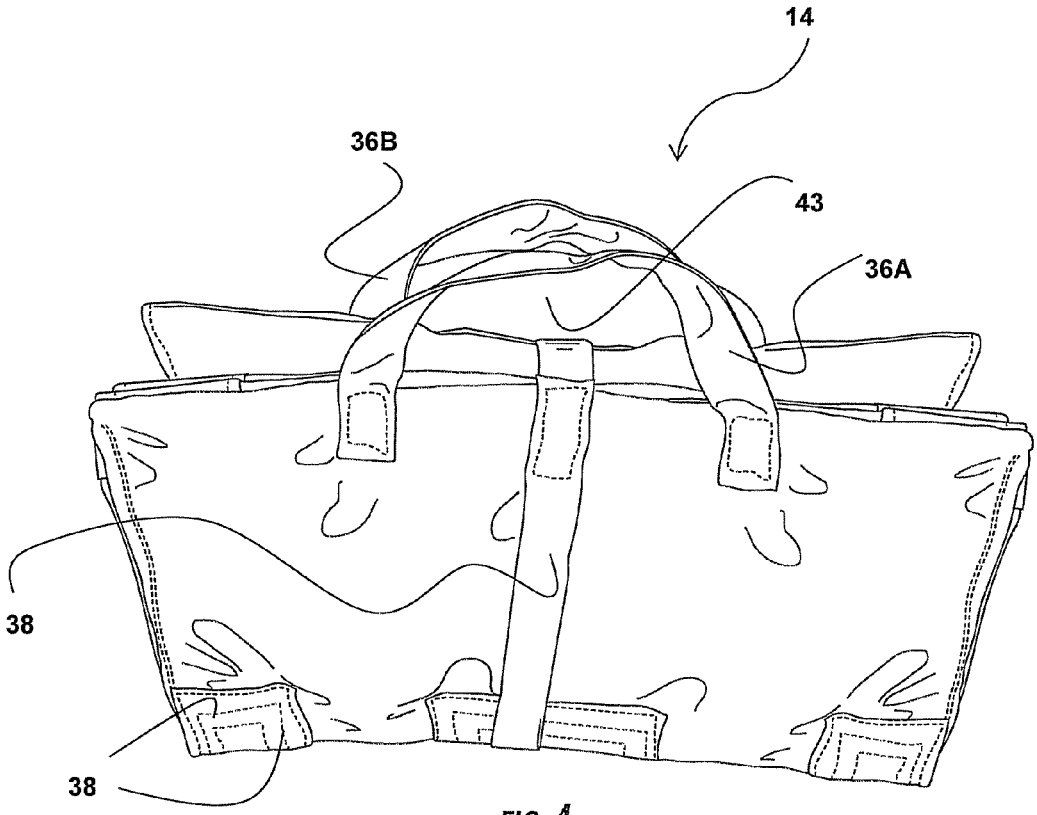
FIG. 4 is an isometric end and top view of the device in a folded position, in accordance with a preferred embodiment.
Figure 5:
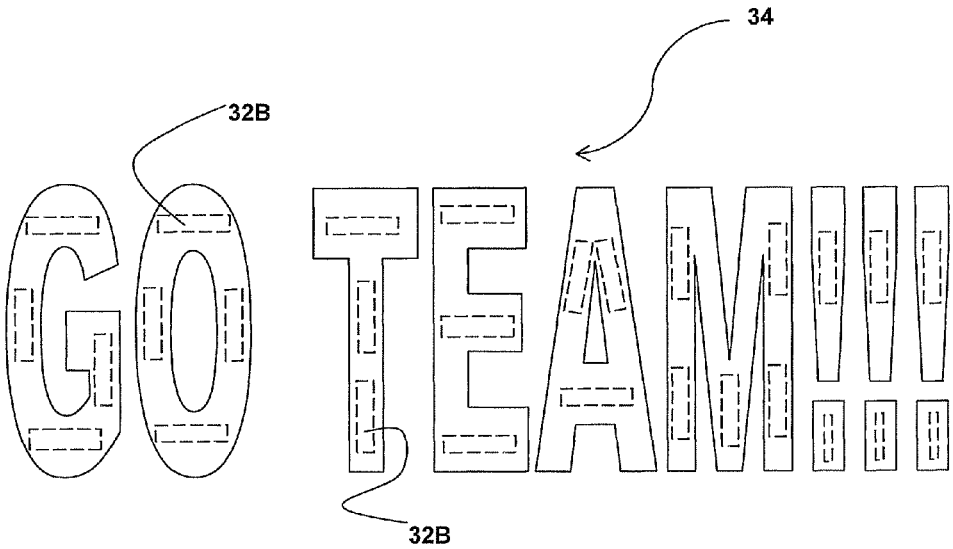
FIG. 5 is a top side plan view of sample insignia, in accordance with a preferred embodiment.

Referring to FIG. 4, when the device 14 is in the folded position, the longer end panels 16A, 16F side edges 42 permit the end edges 28 to be positioned adjacent to one another.

Referring to FIGS. 3-4, the device 14 may be folded such that each panel 16A-16F can be positioned against adjacent panels 16A-16F. The panels 16A-16F are coupled to one another, in part, by one or more reinforcement members 30. Reinforcement members 30 of the preferred embodiment are thickened patches of material that are adapted to be flexible. In this configuration, the reinforcement members 30 act as hinges, permitting the device to be easily folded along a central portion 31, or crease 31, of each reinforcement member 30. Each reinforcement member 30 is biased to permit the two coupled panels, for example, 16A and 16B, to fold away from the surface 22, 24 to which the reinforcement member 30 is attached. In the preferred embodiment, the reinforcement members 30 are alternatively sewn to the upper 22 and lower 24 surface of each panel 16A-16F such that the panels 16A-16F may be easily folded upward and downward in an alternating pattern. Referring to FIG. 4, the preferred embodiment, reinforcement members 30 comprise stitching 33, which strengthens the reinforcement member 30 and reinforces the reinforcement member 30 such that it is less susceptible to being overly flexible. Additionally, the stitching 33 may serve as a means of attachment to the upper 22 or lower surface 24. In the preferred embodiment, the stitching 33 comprises two or more concentric polygons 33.

In the preferred embodiment, the reinforcement members 30 are arranged such that a reinforcement member 30 is positioned adjacent to each side edge 42 and at a position between the outside reinforcement members 30. In this configuration, there are three reinforcement members 30 positioned at each folding point 31. Although in the preferred embodiment three reinforcement members 30 are positioned at each folding point 31, greater or fewer numbers of reinforcement members 30 may be used and the reinforcement members 30 may be place in different positions without departing from the scope and spirit of the invention.

Figure 6:
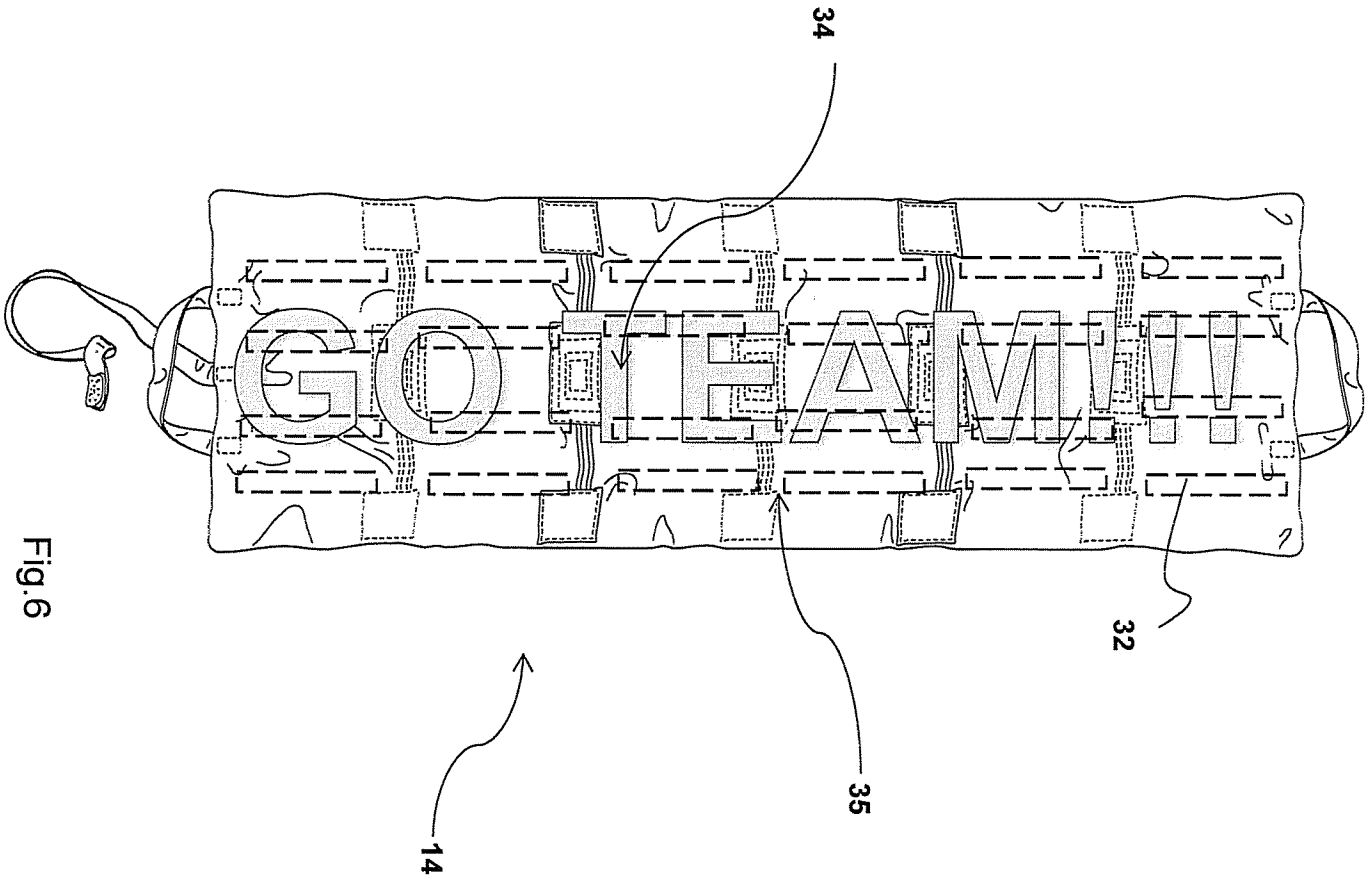
FIG. 6 is the plan view of FIG. 2 with sample insignia coupled to the top surface, in accordance with a preferred embodiment.

Referring to FIGS. 1, 2, & 3, when the device 14 is expanded into an unfolded position, the upper surface 22 (FIG. 1) and lower surface 24 (FIG. 2) surfaces of each panel 16A-16F are displayed. Along the length of the device 14 and between the side edges 28 of each panel 16A-16F are a plurality of strips 32 adapted for cooperative coupling with various insignia 34 (FIGS. 5 & 6) such as letters, numbers, images, logos, and the like. In the preferred embodiment, the cooperative strips 32 comprise a hook 32A and loop 32B system. The hook 32A portions may be coupled to the device 14 or on the insignia 34. In the preferred embodiment, the hook portion 32A is coupled to the device 14, and a loop portion 32B is coupled to the insignia 34. Referring to FIG. 6, with this arrangement, a user desiring to form a banner 35 may do so easily by coupling letters 34 or phrases 34 to the unfolded seat 14.

As illustrated in FIGS. 1-6, in the preferred embodiment, the device 14 comprises carrying straps 36A, 36B and a tie strap 38. In the preferred embodiment, the carrying straps 36A, 36B comprise lengths of webbed material such as polypropylene, nylon, polyester, and may be flat or tubular. The tie strap 38 of the preferred embodiment comprises elastic web material such that it is stretchable. However, tie strap 38 may also be formed from non stretchable material as well. Each carrying strap 36A, 36B comprises strap ends 40 which are each coupled to the upper surface 22 near the and edges 28. Referring to FIGS. 1, 2, & 4, as the straps 36A, 36B are coupled at each end 40, a space 43 is defined which permits a user to grasp the device 14 by the straps 36A, 36B when in the compact folded position illustrated in FIG. 4. The tie strap 38 comprises ends 40A, 40B one 40A of which is coupled to the end panel 16A. The tie strap 38 comprises cooperative strips 32 comprising a hook 32A and loop 32B system. In the preferred embodiment, a hook portion 32A is coupled to the end 40A coupled to the upper surface (see FIG. 1) and the loop portion 32B is coupled to the loose end 40 (see FIG. 2). The device 14 may be easily retained in the compact folded position by securing tie strap 38 around a circumference of the device 14 and securing tie strap loop portion 32B to tie strap hook 32B portion.

In the preferred embodiment, the panel surfaces 22, 24 are formed from a continuous sheet of material and the individual panels 16A-16F and compartments 18 are formed by sewing the upper surface 22 and lower surface 24 together to form the panel 16A-16F and compartment 18. However, in other embodiments, the panels 16A-16F are formed from separate sheets of material. In preferred embodiments, the device 14 is formed from water resistant or waterproof material. However, the device 14 may be formed from other suitable materials or water proofing or water resistant coatings may be added. In the preferred embodiment, the upper surface 22 and lower surface 24 are formed from a synthetic material such as polyester, and the reinforcement members 30 are formed from leather. In the preferred embodiment, each panel 16A-16F comprises a compartment 18 comprising padding 20 comprising foam 20 or other suitable padding material 20I.

The apparatus 14 can be modified to be different lengths, widths, and thicknesses, as well as other variations. Also, the apparatus 14 need not be limited to a rectangular shape. Rather, the apparatus 14 may have a variety of shapes. In other embodiments, for example, the panels 16A-16F may be square or round. A square panel 16A-16F configuration, for example, may be particularly well-suited for seating arrangements comprising individual seats, while a rectangular arrangement may be desirable for seating arrangements comprising benches for bleachers. In one embodiment, the device 14 comprises one or more compartments 18 which may be used for storage. For example, the user may desire to store keys, cell phones, wallets and other personal effects in such compartments 18. Additionally, one or more of the compartments 18 may be used to store the insignia 34 when not in use so that the insignia 34 is readily available during, for example, a sporting event. In embodiments in which one or more of the compartments 18 are adapted for storage, a slit 37 or opening 37 is provided (see FIG. 2). In the preferred embodiment, the slit 37 comprises an elongated narrow opening 37 in the lower surface 24 such that the opening 37 is adapted to permit access to an interior portion of the compartment 18. In other embodiments, the slit 37 is positioned on the upper surface 22. In other embodiments, the opening 37 comprises a cooperative closure arrangement such that the slit/opening 37 may be closed. For example, a zipper, button, snap, or other cooperative coupling arrangements well known in the art may be used to secure the opening 37. In addition to providing access for storing and removing items in panels 16A-16F comprising storage compartments 18, with respect to panels 16A-16F comprising padding 20, the slit 37 may also be used to remove the padding 20 if, for example, the user desires to launder, remove, replace, or add to the padding 20.

In the preferred embodiment, the end panels 16A & 16F have a length of approximately 12½ inches, and each of the interior panels 16B-16E have a length of approximately 12 inches. Each of the panels has a width 16A-16F of approximately 20 inches. Thus, in this embodiment, the overall dimensions of the device 14 in an unfolded position are approximately 73"×20".

In other embodiments, the end panels 16A and 16F have a length of approximately 9½ inches, and each of the interior panels 16B-16E have a length of approximately 9 inches. In this alternative embodiment, each of the panels 16A-16F has a width of approximately 17 inches. Thus, in this alternative embodiment, the overall dimensions of the device 14 in an unfolded position are approximately 55"×17". As discussed above, although in the preferred embodiment, there are six conjoined panels 16A-16F, the device 14 need not have six panels 16A-16F. Rather, the device 14 may have a greater number of panels 16A-16F than six or a fewer number of panels 16A-16F than six. Further, although in the preferred embodiment, the panels 16A-16F are aligned in a single row, the panels 16A-16F need not be so aligned. Rather, the panels may be arranged in two or more rows such that the panels 16A-16F are arranged in a grid-like configuration.

In the preferred embodiment, the end panel 16A & 16F compartments 20 comprise approximately one inch of padding 20, and each of the interior panel 16B-16E compartments 20 comprise approximately ¼ inch of padding 20. However, the panel 16A & 16F compartments 20 may comprise more or less padding 20 or even no padding 20 without departing from the scope and spirit of the invention.

In the preferred embodiment, cooperative strips 32 to which the insignia 34 are coupled are arranged four to a panel along a longitudinal axis of the lower surface 22 of the unfolded device 14 and are each approximately ¾ inches wide and nine inches in length. However, the cooperative strips 32 may be of a different number, of different sizes, or attached to different portions of the device such as, for example, the upper surface 24, without departing from the scope and spirit of the invention.

The insignia 34 coupled to the device 14 of the preferred embodiment comprise characters that are approximately five to eight inches in height and width. Although, in various embodiments, the insignia 34 comprise the foregoing dimensions, the dimensions can be smaller or larger than those described without departing from the scope and spirit of this disclosure. For example, in one embodiment, individual insignia 34 may have dimensions slightly smaller, equal to, or larger than the dimensions of the device 14 when the device 14 is in an unfolded position such that the insignia 34 extends across multiple panels 16A-16F.

In the preferred embodiment, the various elements of the device 14 are sewn together. Additionally, in the preferred embodiment, a line of stitching separates each panel 16A-16F. However, other attaching and coupling methods may be used such as staples, glue, buttons, snaps, pins, clips, and the like, without departing from the scope and spirit of the invention.

The manner using the device 14 will not be discussed. A user desiring to display a message 34, unfolds the device 14 to an expanded, unfolded position with the lower surface 24 exposed. The user then chooses an appropriate insignia 34 and attaches the insignia 34 to the lower surface 24 of the device 14 while the device 14 is in an unfolded position. The device 14 may then be used as a banner 35 by holding up the device 14 with the insignia 34 facing the target for the display and displaying the insignia 14. When the user desires to use the device 14 as a seat cushion 14, the user folds the device 14 along the lines 31 defined by the separation of panels, secures the tie strap 38, and sits on the device 14.

The present disclosure also presents a method of using a seat cushion 14 to display a message 34. In a preferred embodiment of the method, the method comprises the steps of providing a banner 35 adapted to be folded into a seat, applying one or more insignia 34 to a surface 22, 24 of the banner 35 when the banner 35 is in an unfolded position, and displaying banner 35 and insignia 34

In a preferred embodiment of the method, the method of using a seat cushion 14 to display a message 34 comprises the steps of providing a seat cushion 14, the cushion 14 comprising a foldable length of material which, when in a folded position, is adapted for sitting, and when in an expanded, unfolded position, is adapted for use as a banner 35; providing one or more insignia 34 adapted to be removably coupled to a surface 22, 24 of said seat cushion 14; said surface 22, 24 being adapted for receiving said insignia 34; coupling said one or more insignia 34 to said seat cushion 14; displaying said unfolded seat cushion 14. In one embodiment the method, the seat cushion 14 comprises a plurality of conjoined panels 16A-16F, each comprising a closed compartment 18 comprising padded material 20. In one embodiment of the method, the seat cushion 14 comprises a length, the length comprising a plurality of panels 16A-16F. In one embodiment of the method, each of the panels 16A-16F is generally rectangular in shape and comprises an upper layer 22 and a lower layer 24 joined together to form the compartment 18 within a rectangular panel perimeter.

In one embodiment of the method, the panels 16A-16F comprise end panels 16A & 16F, each panel 16A-16F perimeter comprises a length and a width such that two side edges 42 comprise the length, and two borders 40 comprise the width, the edges 42 comprising the length being shorter than the edges 42 comprising the width, and except for an exposed end edge 28 of each of the end panels 16A & 16F, the panels 16A-16F are joined with each other along the longer borders 40 of each panel 16A-16F.

In one embodiment of the method, the end panels 16A & 16F have slightly longer side edges 42 than the interior panel side edges 42 such that when the device 14 is folded, the exposed end edges 28 of the end panels 16A & 16F may be placed adjacent to one another.

In one embodiment of the method, the seat cushion 14 may be folded such that each panel 16A-16F can be positioned against adjacent panels 16A-16F. In one embodiment of the method, the panels 16A-16F are coupled to one another, in part, by one or more reinforcement members 30. In one embodiment of the method, each reinforcement member 30 is biased to permit the two panels 16A-16F to fold away from a surface 22, 24 to which the reinforcement member 30 is attached. In one embodiment of the method, the reinforcement members 30 are alternatively sewn to the upper surface 22 and lower surface 24 of each panel 16A-16F such that the panels 16A-16F may be easily folded upward and downward in an alternating pattern.

The foregoing disclosure and showings made in the drawing are merely illustrative of the principles of this invention and are not to be interpreted in a limiting sense. While the invention is shown in only a few forms, it is not just limited to the forms shown, but is susceptible to various changes and modifications without departing from the spirit thereof. The foregoing description of a preferred embodiment of the invention has been presented for the purpose of illustration and description. It is not intended to be exhaustive or to limit the invention to the precise form disclosed. Obvious modifications or variations are possible in light of the above teachings. The invention may be adapted for use in a number of environments.

The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention in accordance with the breadth of this disclosure, to which it is fairly, legally, and equitably entitled to be interpreted.

I claim:

1. In combination, a seat and banner apparatus comprising:

first and second ends, a first elongated length of material comprising an upper layer, a second elongated length of material comprising a lower layer, the first and second elongated lengths of material each being continuous between said first and second ends;

a plurality of panels, each of said panels comprising a panel perimeter being defined by perimeter stitching, said perimeter stitching being positioned at the panel perimeter of each panel, said perimeter stitching joining said upper and lower layers together;

said perimeter stitching further defining a compartment, the compartment being positioned within each panel perimeter and between the upper and lower layers;

one or more of said compartments comprising padding;

said plurality of panels comprising at least first and second flexible member panels, said first and second flexible member panels being adjacent to one another and comprising a flexible member;

said flexible member extending from said first flexible member panel to the second flexible member panel, such that the flexible member overlaps a surface between said first and second flexible member panels;

said flexible member being coupled external to said upper or lower layer and biased such that the second flexible member panel folds away from the layer to which the flexible member is attached; and wherein said apparatus, when in a folded position, is adapted for use as a seat, and when in an unfolded position is adapted for use as a banner.

2. The apparatus of claim 1, the plurality of panels comprising end panels, said end panels comprising handles;

at least one of said upper and lower layers comprising first coupling portions adapted for cooperative coupling to second coupling portions of one or more insignia, the first coupling portions being positioned on an outer surface within the perimeter of two or more panels.

3. The apparatus of claim 1, said plurality of panels further comprising third and fourth flexible member panels;

wherein said first and second flexible member panels are interior panels and said third and fourth flexible member panels are end panels;

the third flexible member panel and first flexible member panel comprising one or more upper flexible members;

the first and second flexible member panels comprising one or more lower flexible members;

the upper flexible members being positioned on an outer surface of the upper layer, the lower flexible members being positioned on an outer surface of the lower layer, the lower layer outer surface of the third flexible member panel being positioned against the lower layer outer surface of the first flexible member panel, when the apparatus is in the folded position; and the upper layer outer surface of the first flexible member panel being positioned against the upper layer outer surface of the second flexible member panel when the apparatus is in the folded position.

4. The apparatus of claim 1, further comprising an elongated strap member adapted to extend around a circumference of said apparatus and maintain said apparatus in said folded position.

5. The apparatus of claim 4, said strap member comprising a cooperative coupling arrangement.

6. A method of using a seat cushion to display a message, the method comprising the steps of:

providing a seat cushion, said cushion comprising a foldable length of material which, when in a folded position, is adapted for sitting, and when in an expanded, unfolded position, is adapted for use as a banner;

said cushion comprising a continuous upper layer spanning between first and second ends, and a continuous lower layer spanning between said first and second ends;

said cushion further comprising a plurality of panels, each of said panels comprising perimeter stitching, said perimeter stitching joining said upper and lower layers together and defining a perimeter of each panel, said perimeter stitching further defining a compartment, said compartment being positioned within each panel perimeter between said upper and lower layers;

said plurality of panels comprising at least first and second flexible member panels, said first and second flexible member panels being adjacent to one another and comprising a flexible member;

said flexible member extending from said first flexible member panel to the second flexible member panel, such that the flexible member overlaps a surface between said first and second flexible member panels;

said flexible member coupled external to said upper or lower layers and biased such that the second flexible member panel folds away from the layer to which the flexible member is attached;

providing one or more insignia adapted for removable coupling to one or more of said upper and lower layers of said seat cushion, said one or more layers comprising outer surfaces adapted for receiving said insignia;

removably coupling said one or more insignia to said seat cushion; and displaying said unfolded seat cushion.

7. The method of claim 6, one or more of said compartments comprising padded material.

8. The method of claim 7, one or more of said panels being rectangular.

9. The method of claim 7, the plurality of panels further comprising third and fourth flexible member panels, the first and second flexible member panels being interior panels and said third and fourth flexible member panels being end panels;

each of said first, second, third, and fourth flexible member panels comprising side edges, said third and fourth flexible member panels each comprising an end edge, said side edges each having a length, said third and fourth flexible member panel side edges length being greater than said first and second flexible member panel side edges length, such that when the seat cushion is folded, the third and fourth flexible member panel end edges are adapted to be positioned adjacent to one another.

10. The method of claim 7, further comprising an elongated strap member adapted to extend around a circumference of said seat cushion and maintain said seat cushion in said folded position.

11. The method of claim 10, said strap member comprising a cooperative coupling arrangement.

* * * * *